US007753733B2

(12) United States Patent
Kameyama et al.

(10) Patent No.: US 7,753,733 B2
(45) Date of Patent: Jul. 13, 2010

(54) SHIELD CONNECTOR

(75) Inventors: Isao Kameyama, Susono (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/417,816

(22) Filed: Apr. 3, 2009

(65) Prior Publication Data

US 2009/0253298 A1 Oct. 8, 2009

(30) Foreign Application Priority Data

Apr. 7, 2008 (JP) ..... 2008-098958

(51) Int. Cl.
*H01R 13/648* (2006.01)

(52) U.S. Cl. ..... 439/607.35

(58) Field of Classification Search ..... 439/607.1, 439/607.11, 607.28, 607.35
See application file for complete search history.

(56) References Cited

U.S. PATENT DOCUMENTS 5,035,652 A * 7/1991 Shibano ..... 439/607.47
5,637,014 A * 6/1997 Sukegawa et al. ..... 439/607.4
6,238,241 B1 * 5/2001 Zhu et al. ..... 439/607.01
6,383,024 B1 * 5/2002 Wang et al. ..... 439/607.35
6,447,311 B1 * 9/2002 Hu et al. ..... 439/607.28
6,755,689 B2 * 6/2004 Zhang et al. ..... 439/607.01
6,948,984 B2 * 9/2005 Chen et al. ..... 439/607.01

FOREIGN PATENT DOCUMENTS

JP 2005-38725 A 2/2005

* cited by examiner

*Primary Examiner*—Briggitte R. Hammond
(74) *Attorney, Agent, or Firm*—Sughrue Mion, PLLC

(57) ABSTRACT

A shield connector 1 includes an L-shaped terminal 2 which includes an opposite-side connection portion 21; an inner housing 3 which holds a terminal 2; a tubular inner shell 4 which surrounds the opposite-side connection portion 21; a tubular outer housing 5 which accommodates the inner shell 4; and an outer shell 6 which is attached to the outer housing 5. The outer shell 6 includes a covering portion 64 which covers a second opening 71 of the outer housing 5 and a first opening 81 of the inner shell 4; a pair of sandwiching portions 66 which is bent upward from the outer edge of the covering portion 64 so as to elastically sandwich the inner shell 4 therebetween; and an earth portion which is grounded.

2 Claims, 6 Drawing Sheets

SHIELD CONNECTOR

BACKGROUND OF THE INVENTION

1. Field of the Invention

The present invention relates to a shield connector having a shell used to electromagnetically shield a terminal.

2. Description of the Related Art

FIG. 5 is an exploded view showing a known shield connector. FIG. 6 is a perspective view showing the state where the known shield connector of FIG. 5 is assembled.

A known shield connector 200 shown in FIGS. 5 and 6 includes plural PCB terminals 201 and 202; an inner housing 203 which hold the PCB terminals 201 and 202; an inner shell which includes two components of a front shell 204 and a back shell 205 attached to the outer surfaces of the inner housing 203 so as to shield the PCB terminals 201 and 202; a tubular outer housing 206 which accommodates the inner shell attached to the inner housing 203; and an outer shell 207 which is attached to the outer periphery of the outer housing 206 so as to shield the PCB terminals 201 and 202 and is attached to a housing.

Each of the PCB terminals 201 and 202 is configured as an L-shaped terminal including an opposite-side connection portion fitted to an opposite terminal and a substrate-side connection portion that extends in a direction perpendicular to the opposite-side connection portion and is connected to a print substrate.

The inner housing 203 and the outer housing 206 are formed of an insulating synthetic resin. In addition, the front shell 204, the back shell 205, and the outer shell 207 are obtained by performing a pressing process on a metal plate.

In the above-described shield connector 200, the plural PCB terminals 201 and 202 are inserted into the inner housing 203, and the inner housing 203 is fitted between the front shell 204 and the back shell 205. At this time, a locking protrusion 241 provided in the front shell 204 is locked to a locking portion 231 provided in the inner housing 203, and a bent piece 251 provided in the back shell 205 is locked to a locking portion 242 provided in the front shell 204, thereby electrically connecting the front shell 204 and the back shell 205 to each other so as to be attached to the inner housing 203.

The inner shell (204 and 205) attached to the inner housing 203 is inserted into the outer housing 206, and the outer housing 206 is inserted into the outer shell 207, thereby obtaining the assembled shield connector 200 shown in FIG. 6. At this time, a locking piece 243 provided in the front shell 204 is locked to a locking portion provided in the outer housing 206, and a press-fitting piece 254 provided in the back shell 205 is press-fitted to a press-fitting hole portion provided in the outer housing 206.

In addition, when the outer housing 206 is inserted into the outer shell 207, a spring piece 255 provided in the back shell 205 comes into contact with the inner surface of the outer shell 207 so that the front shell 204, the back shell 205, and the outer shell 207 are electrically connected to one another. In addition, the front shell 204 and the back shell 205 are grounded in such a manner that respective soldering portions 244 and 253 thereof are soldered to the print substrate (see Patent Document 1).

Patent Document 1: JP-A-2005-38725

Incidentally, in this kind of shield connector, since a shield performance becomes larger as a gap between shells surrounding the terminal becomes smaller, in order to ensure a high shield performance, the known shield connector 200 includes the inner shell formed by two components of the front shell 204 and the back shell 205 so as to minimize a gap of the inner shell. That is, an opening of the front shell 204 is configured to be covered by the back shell 205. In addition, the outer shell 207 is also provided so as to reinforce a shield performance. Likewise, the known shield connector 200 uses three components of shells.

However, in the above-described known shield connector 200, since the inner shell is formed by two components, a problem arises in that the number of components increases and trouble is taken for the assembling operation. In addition, in the case where the shell for shielding the terminal is formed by one component, since an entrance or leakage of noise occurs in an opening, which is used to insert the terminal into the shell, it is difficult to improve a shield performance.

SUMMARY OF THE INVENTION

Accordingly, an object of the invention is to provide a shield connector in which the number of components is small, an assembling operation can be easily carried out, and a shield performance is high.

In order to achieve the above-described object, according to a first aspect of the invention, there is provided a shield connector including: (a) an L-shaped terminal which includes an opposite-side connection portion fitted to an opposite terminal and a substrate-side connection portion extending in a direction perpendicular to the opposite-side connection portion so as to be connected to a print substrate; (b) an inner housing which holds the terminal; (c) an inner shell which is formed in a tube shape by bending a metal plate and is attached to an outer periphery of the inner housing in a shape in which the opposite-side connection portion is surrounded; (d) a tubular outer housing which accommodates the inner shell in a shape in which the opposite-side connection portion is surrounded; and (e) an outer shell which is formed by bending a metal plate and is attached to the outer housing, wherein (A) the inner shell is provided with a notch portion which is formed by cutting a part of the inner shell from an outer edge on the side of a first opening, allowing the inner housing to be inserted therethrough, toward the other opening, allowing the opposite terminal to be inserted therethrough, and which allows the substrate-side connection portion to pass therethrough, wherein (B) the outer housing is provided with a notch portion which is formed by cutting a part of the outer housing from an outer edge on the side of a second opening, allowing the inner shell to be inserted therethrough, toward the other opening, allowing the opposite terminal to be inserted therethrough, and which allows the substrate-side connection portion to pass therethrough, and wherein (C) the outer shell is provided with a covering portion which covers the first opening of at least the inner shell, a pair of sandwiching portions which is bent upward from an outer edge of the covering portion and elastically sandwiches the inner shell therebetween, and an earth portion which is grounded.

A second aspect of the invention provides the shield connector according to the first aspect, wherein the first opening of the inner shell and the second opening of the outer housing are disposed on the same plane, and wherein the covering portion covers both the first opening and the second opening.

According to the first aspect of the invention, since the outer shell is provided with a covering portion which covers the first opening of at least the inner shell and a pair of sandwiching portions which is bent upward from an outer edge of the covering portion and elastically sandwiches the inner shell therebetween, it is possible to prevent noise from entering from the first opening to the inside of the inner shell or leaking from the first opening to the outside of the inner shell. Accordingly, even when the shape of the inner shell is a tube shape provided with the first opening, it is possible to ensure a high shield performance. Since the tubular inner shell can be formed by one component, it is possible to provide the shield connector in which the number of components is small, an assembling operation can be easily carried out, and a shield performance is high. In addition, since the pair of elastic sandwiching portions comes into contact with the inner shell so as to sandwich the inner shell therebetween, it is possible to ensure high reliability upon electrically connecting the outer shell to the inner shell. Accordingly, it is possible to provide the shield connector having the higher shield performance.

According to the second aspect of the invention, since the first opening of the inner shell and the second opening of the outer housing are disposed on the same plane, it is possible to simultaneously cover both the first opening and the second opening by forming the covering portion to have a shape in which the second opening can be covered. Accordingly, it is possible to prevent noise from entering from the second opening to the inside of the outer housing or leaking from the second opening to the outside of the outer housing. As a result, it is possible to provide the shield connector having the higher shield performance.

DESCRIPTION OF THE PREFERRED EMBODIMENTS

Figure 1:
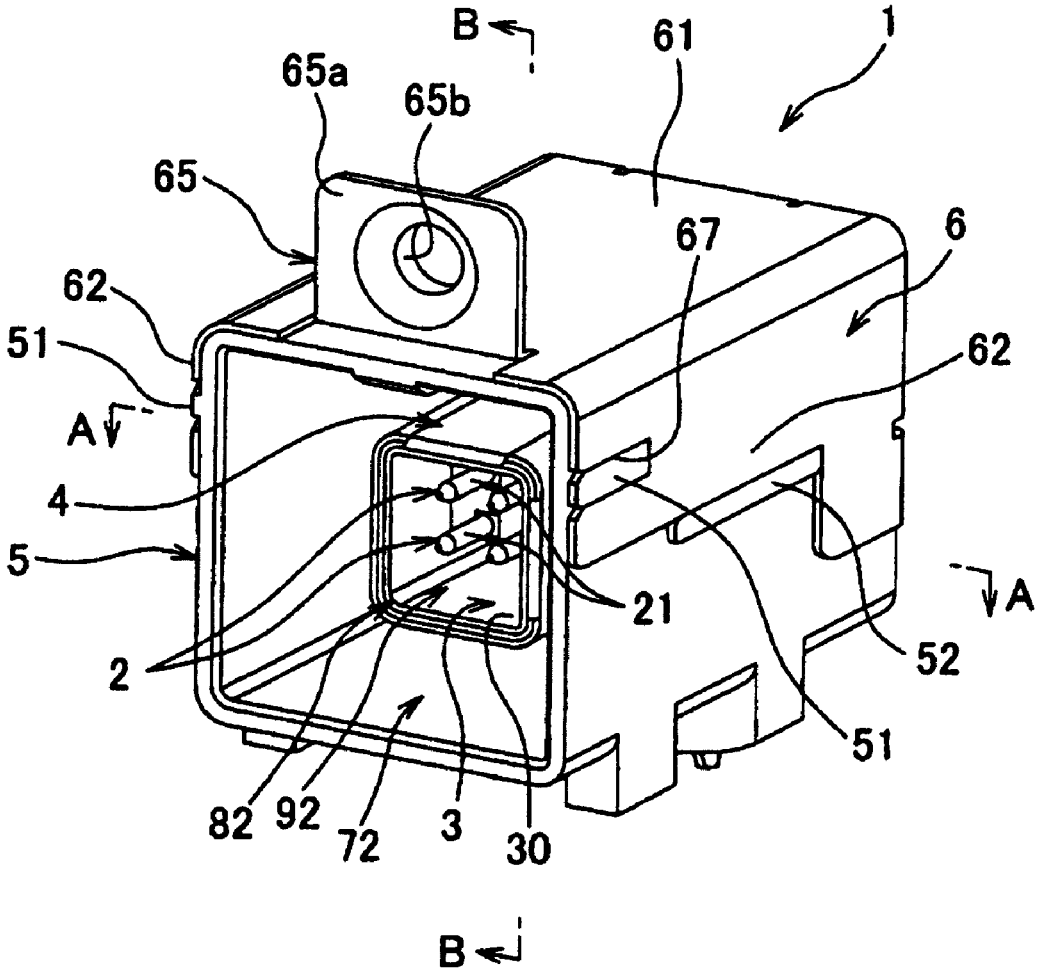
FIG. 1 is a perspective view showing a shield connector according to an embodiment of the invention.
Figure 2:
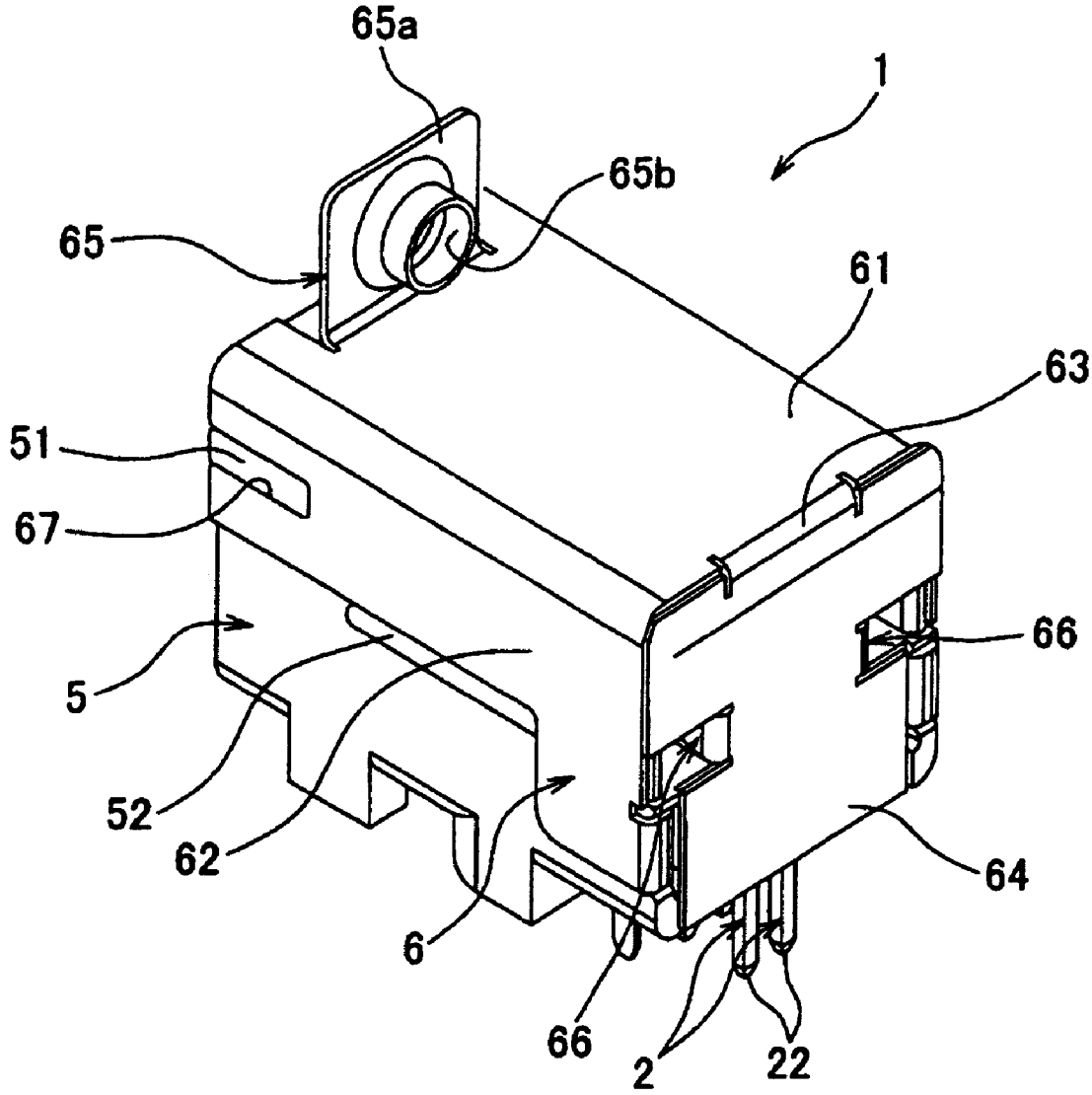
FIG. 2 is a perspective view showing the shield connector of FIG. 1 when viewed in a different direction.
Figure 3:
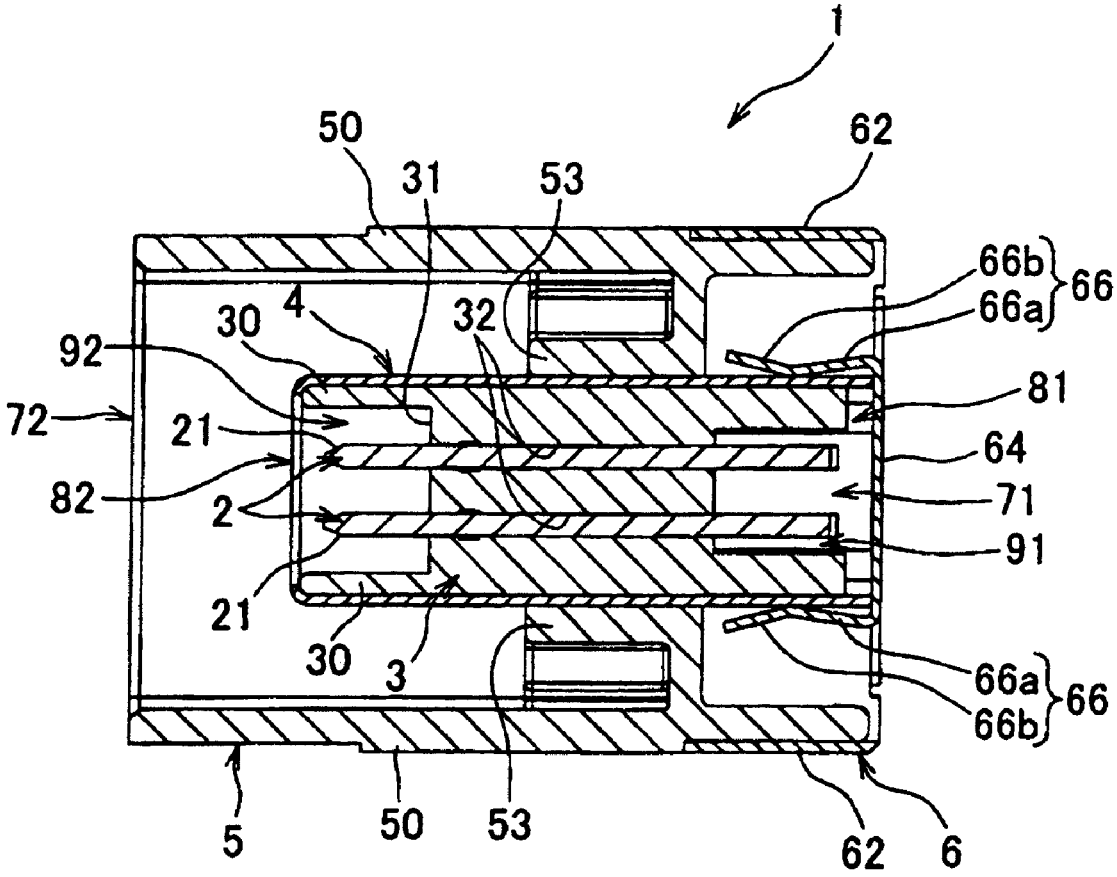
FIG. 3 is a sectional view taken along the line A-A of FIG. 1.
Figure 4:
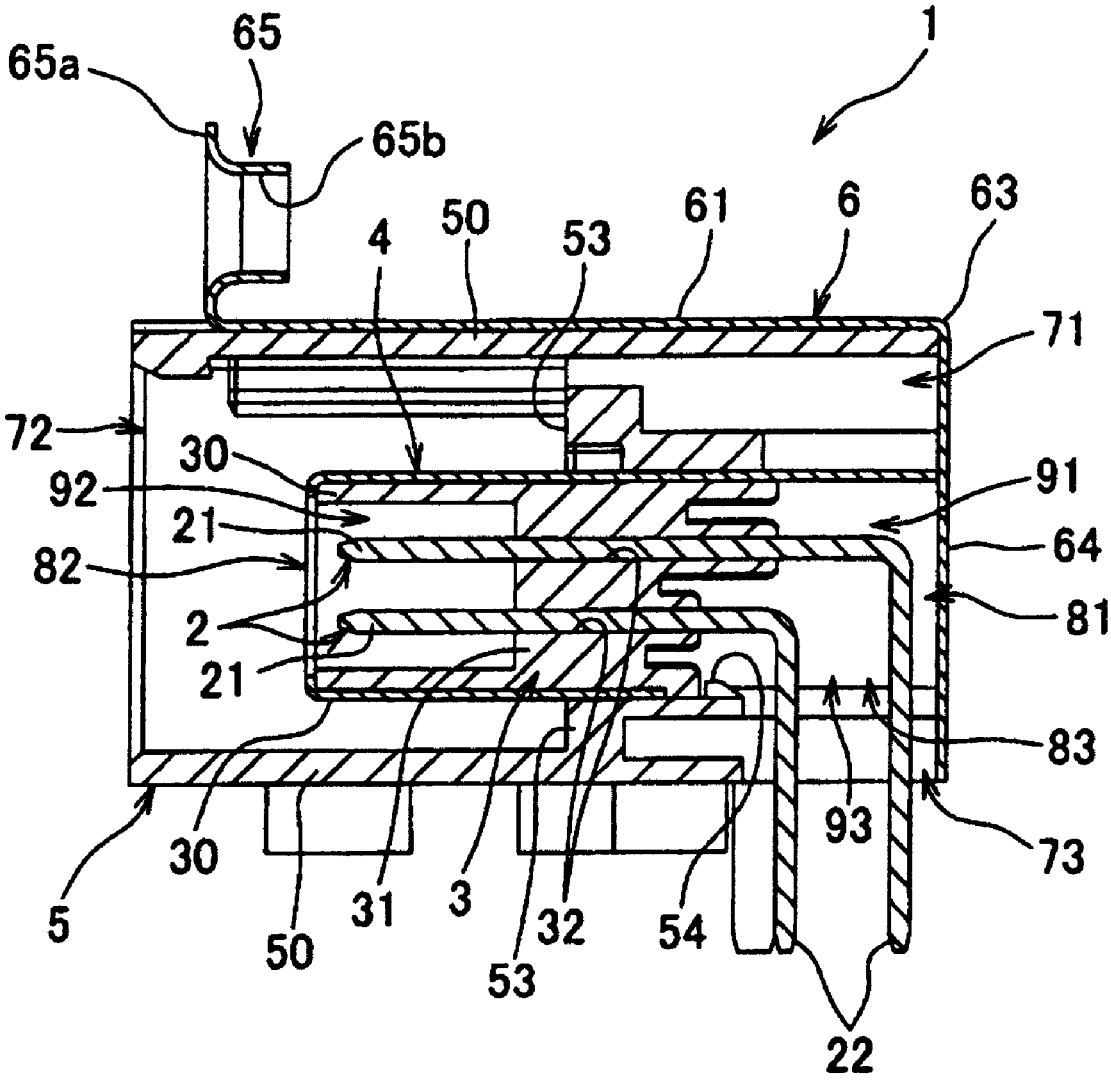
FIG. 4 is a sectional view taken along the line B-B of FIG. 1.
Figure 5:
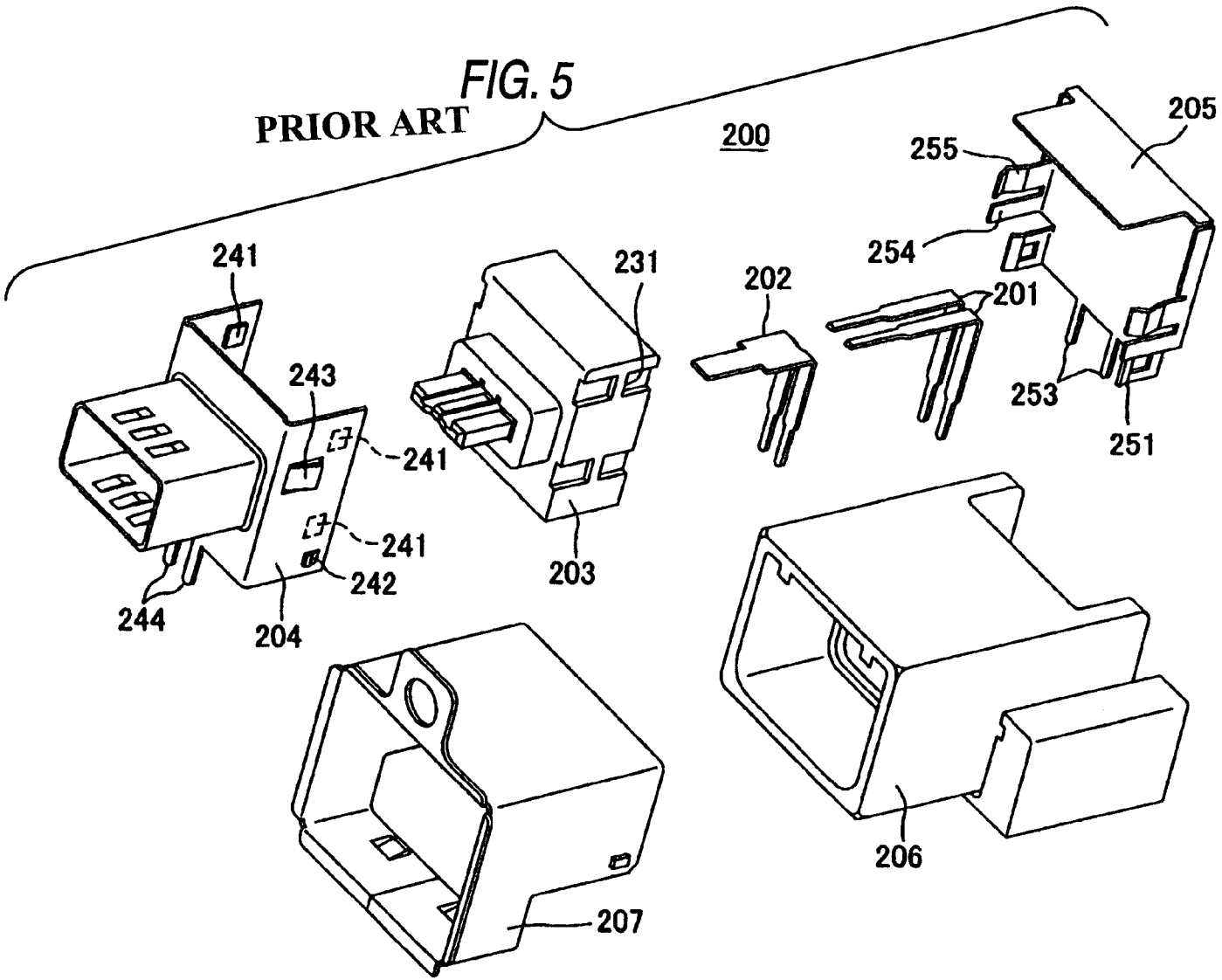
FIG. 5 PRIOR ART
FIG. 5 is an exploded view showing a known shield connector.
Figure 6:
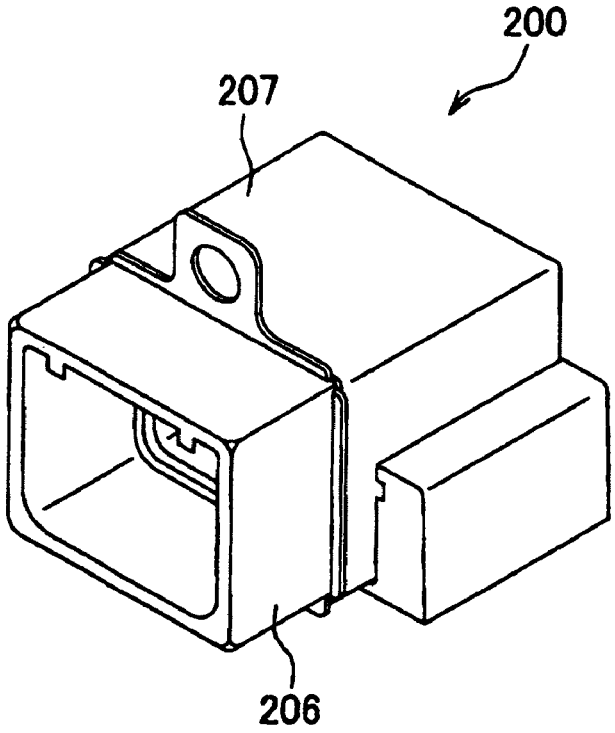
FIG. 6 PRIOR ART
FIG. 6 is a perspective view showing the state where the known shield connector of FIG. 5 is assembled.

A shield connector according to an embodiment of the invention will be described with reference to FIGS. 1 to 4. FIG. 1 is a perspective view showing a shield connector according to an embodiment of the invention. FIG. 2 is a perspective view showing the shield connector of FIG. 1 when viewed in a different direction. FIG. 3 is a sectional view taken along the line A-A of FIG. 1. FIG. 4 is a sectional view taken along the line B-B of FIG. 1.

A shield connector 1 according to the invention is a connector which connects an electric wire to a print substrate via an opposite connector attached to a terminal of the electric wire. As shown in FIG. 1, the shield connector 1 includes four terminals 2; an inner housing 3 which holds the terminals 2; an inner shell 4 which is attached to the outer periphery of the inner housing 3; an outer housing 5 which accommodates the inner shell 4; and an outer shell 6 which is attached to the outer housing 5.

As shown in FIG. 4, each terminal 2 is formed in an L-shape and includes a bar-shaped opposite-side connection portion 21 which is fitted to an opposite terminal forming an opposite connector and a substrate-side connection portion 22 which extends in a bar shape in a direction perpendicular to the opposite-side connection portion 21 and is connected to the print substrate. The substrate-side connection portion 22 is press-fitted to a through-hole of the print substrate and is soldered thereto so as to be connected to a circuit of the print substrate. Such terminals 2 are called "PCB terminals".

The opposite terminal is accommodated in a housing of the opposite connector, and includes an electric wire connection portion that is connected to the electric wire and a tubular fitting portion which is fitted to the opposite-side connection portion 21.

The inner housing 3 is formed of an insulating synthetic resin, and is formed in an angular tube shape by four plate-shaped outer walls 30. In addition, as shown in FIG. 4, the center portion in an axial direction of the angular tube shape on the inside of the outer walls 30 is provided with a terminal holding portion 31 which holds the center portion in a longitudinal direction of the opposite-side connection portion 21.

The terminal holding portion 31 is formed in such a manner that a synthetic resin is filled into the center portion in an axial direction of the angular tube shape on the inside of the outer walls 30 and four long holes 32 are formed through the filled portion by a perforating process so as to communicate with the opposite-side connection portion 21. In addition, the long holes 32 extend in the axial direction, and communicate with both one opening 91 and the other opening 92 of the inner housing 3.

In addition, the above-described terminals 2 are inserted into the inner housing 3 from one opening 91 toward the other opening 92, and the opposite-side connection portion 21 is inserted into the long hole 32 from the front end thereof so as to be held by the terminal holding portion 31. That is, in the state where the terminals 2 are held by the terminal holding portion 31, the front end of the opposite-side connection portion 21 away from the substrate-side connection portion 22 is positioned so as to be closer to the other opening 92 than the terminal holding portion 31, the center portion of the opposite-side connection portion 21 is positioned to the inside of the long hole 32, and the rear end of the opposite-side connection portion 21 on the side of the substrate-side connection portion 22 is positioned so as to be closer to one opening 91 than the terminal holding portion 31. In addition, the four terminals 2 are held so as to have a gap therebetween.

One outer wall 30 of the plural outer walls 30 of the inner housing 3 is provided with a notch portion 93 where the front end of the substrate-side connection portion 22 of the terminal 2 held by the terminal holding portion 31 protrudes toward the outer wall of the inner housing 3. The notch portion 93 is formed in such a manner that a part of one outer wall 30 is cut from the outer edge on the side of one opening 91 toward the other opening 92. In addition, the other opening 92 accommodates the fitting portion of the opposite terminal.

The inner shell 4 is formed in an angular tube shape by bending a metal plate. In addition, the above-described inner housing 3 is inserted into the inner shell 4 from one opening (hereinafter, referred to as a first opening) 81 of the inner shell 4 toward the other opening 82 so as to be assembled in the inner shell 4. Likewise, the inner shell 4 is attached to the outer periphery of the inner housing 3 so as to have a shape in which the opposite-side connection portion 21 is surrounded. In addition, the other opening 82 accommodates the fitting portion of the opposite terminal.

The inner shell 4 is provided with a notch portion 83 where the front end of the substrate-side connection portion 22 protrudes to the outside of the inner shell 4. The notch portion 83 is formed in such a manner that a part of the inner shell 4 is cut from the outer edge on the side of the first opening 81 toward the other opening 82.

The inner shell 4 having the above-described configuration prevents noise, that is, unnecessary electromagnetic wave flying in a space from entering the inner shell 4 and prevents the noise from leaking to the outside from the inside of the inner shell 4. That is, the terminals 2 are electromagnetically shielded.

The outer housing 5 is formed of an insulating synthetic resin, and is formed in an angular tube shape by means of four plate-shaped outer walls 50. In addition, the inner surfaces of the outer walls 50 are provided with an inner wall 53 that is formed in a convex shape from the inner surfaces to the center of the outer housing 5.

In addition, the above-described inner shell 4 is inserted into the outer housing 5 from one opening (hereinafter, referred to as a second opening) of the outer housing 5 toward the other opening 72 so as to be assembled in the outer housing 5. At this time, the outer surface of the inner shell 4 comes into contact with the inner wall 53 so that the assembling operation is carried out in the state where a gap is provided between the outer surface of the inner shell 4 and the outer wall 50 of the outer housing 5. In addition, a locking protrusion 54 (see FIG. 3) provided in the inner wall 53 is locked to the notch portion 93 of the inner housing 3. In the state where the inner shell 4 is assembled in the outer housing 5, the first opening 81 of the inner shell 4 and the second opening 71 of the outer housing 5 are disposed on the same plane.

Likewise, the outer housing 5 accommodates the inner shell 4 so as to have a shape in which the opposite-side connection portion 21 is surrounded. In addition, the other opening 72 accommodates a hood portion forming the housing of the opposite connector and a fitting portion of the opposite terminal. The hood portion is inserted between the outer surface of the inner shell 4 and the outer wall 50 of the outer housing 5.

In addition, one outer wall 50 of the plural outer walls 50 of the outer housing 5 is provided with a notch portion 73 where the front end of the substrate-side connection portion 22 protrudes to the outside of the outer housing 5. The notch portion 73 is formed in such a manner that a part of the one outer wall 50 is cut from the outer edge on the side of the second opening 71 toward the other opening 72.

The outer shell 6 is formed by bending a metal plate. As shown in FIG. 2 and the like, the outer shell 6 includes a plate-shaped body portion 61; a pair of side portions 62 which is uprightly formed in a plate shape in a direction from both outer edges of the body portion 61 in a transverse direction; an earth portion 65 which is provided one outer edge of the body portion 61 in a longitudinal direction; a covering portion 64 which is uprightly formed in a plate shape in the same direction as that of the pair of side plate portions 62 from the other outer edge 63 of the body portion 61 in a longitudinal direction; and a pair of sandwiching portions 66.

The body portion 61 overlaps with the outer surface of the outer wall 50 opposed to the outer wall 50 provided with the notch portion 73 among the outer walls 50 of the outer housing 5. In addition, the body portion 61 overlaps with the outer surface of the outer wall 50 in a direction in which one outer edge in the longitudinal direction is positioned so as to be close to the other opening 72 of the outer housing 5.

The pair of side portions 62 overlaps with the outer surfaces of the outer walls 50 perpendicular to the outer wall 50 provided with the notch portion 73 among the outer walls 50 of the outer housing 5. In addition, the outer edges of the pair of side portions 62 positioned to be close to the opening 72 are provided with a slit 67 that extends in a linear shape toward the outer edge positioned to be close to the second opening 71. A convex portion 51, which is provided in the outer surface of the outer wall 50 so as to have a convex shape, is positioned to the inside of the slit 67. In addition, this outer wall 50 is provided with a guide convex portion 52 that comes into contact with the outer edge of the side portion 62 away from the body portion 61 and is formed in the outer surface of the outer wall 50 so as to have a convex shape.

The body portion 61 and the pair of side portions 62 having the above-described configuration reinforce a shield performance of the inner shell 4. That is, since this shield connector 1 has a multi-layer structure in which the body portion 61 and the pair of side portions 62 are positioned to the outside of the inner shell 4, it is possible to improve a noise attenuation rate.

The earth portion 65 is formed in such a manner that a bolt hole **65*b* is provided at the center portion of a plate-shaped portion 65*a* uprightly formed in the body portion 61. In addition, the plate-shaped portion 65*a* is bent in a direction opposite to the pair of side portions 62. The earth portion 65 is fixed to the housing and is grounded to the housing in such a manner that the plate-shaped portion 65*a* overlaps with a metallic housing of the electronic device and a bolt is attached to the bolt hole 65*b***. That is, the housing forms the ground described in "CLAIMS".

As shown in FIGS. 3 and 4, the covering portion 64 has the substantially same shape as the sectional shape (a sectional shape in a direction perpendicular to an axial direction of the outer housing 5) of the outer housing 5, and covers both the first opening 81 and the second opening 71. The covering portion 64 prevents the case where noise enters from the first opening 81 and the second opening 71 to the inside of the inner shell 4 and the outer housing 5 and the case where noise leaks from the first opening 81 and the second opening 71 to the outside of the inner shell 4 and the outer housing 5.

Likewise, in this invention, since the first opening 81 of the inner shell 4 can be covered by the opening 64, even when the shape of the inner shell 4 is a tube shape provided with the first opening 81, it is possible to ensure a high shield performance. Since the tubular inner shell 4 can be formed by one component, it is possible to provide the shield connector 1 in which the number of components is small, an assembling operation can be easily carried out, and a shield performance is high.

The covering portion 64 according to this embodiment is formed in a shape in which both the first opening 81 and the second opening 71 can be covered, but the invention is not limited thereto so long as the covering portion 64 is formed in a shape in which at least the first opening 81 can be covered.

In addition, in this invention, since the first opening 81 of the inner shell 4 and the second opening 71 of the outer housing 5 are disposed on the same plane, the covering portion 64 having a simple configuration is capable of covering the first opening 81 and the second opening 71 without a gap therebetween. Accordingly, it is possible to ensure the higher shield performance.

The pair of sandwiching portion 66 is formed in such a manner that two outer edges not contacting with the outer edges 63 of the body portion 61 among the outer edges of the covering portion 64 are bent upward so as to be opposed to each other. The pair of sandwiching portions 66 is electrically connected to the inner shell 4 by elastically sandwiching the inner shell 4 therebetween. Specifically, as shown in FIG. 3, the pair of sandwiching portions 66 is formed in a U-shape by base ends **66*a* which extend in a direction close to each other as the distance from the covering portion 64 becomes large and front ends 66*b* which are respectively connected to the base ends 66*a* and extend in a direction away from each other as the distance from the covering portion 64 becomes large. A width between the pair of sandwiching portions 66 is smaller than a width of the inner shell 4 in the state where the inner shell 4 is not sandwiched therebetween. In addition, when the inner shell 4 is pressed between the pair of sandwiching portions 66 in a shape in which the width between the pair of sandwiching portions 66 becomes wide, the inner shell 4 is elastically sandwiched between the pair of sandwiching portions 66**.

Likewise, in this invention, since the pair of elastic sandwiching portions 66 comes into contact with the inner shell 4 so as to sandwich the inner shell 4 therebetween, it is possible to ensure high reliability upon electrically connecting the outer shell 6 to the inner shell 4. Accordingly, it is possible to provide the shield connector 1 having the higher shield performance.

The shield connector 1 having the above-described configuration electromagnetically shields the plural terminals 2 by means of the inner shell 4 and the outer shell 6. In addition, noise, flowing through the inner shell 4, flows to the housing, that is, a ground via the outer shell 6.

Next, an assembling method of the above-described shield connector 1 will be described.

First, the plural terminals 2 are assembled in the inner housing 3. Subsequently, the inner housing 3 is inserted into the inner shell 4 from the first opening 81 so as to be assembled in the inner shell 4. Subsequently, the inner shell 4 is inserted into the outer housing 5 from the second opening 71 so as to be assembled in the outer housing 5. Further, the outer shell 6 is assembled in the outer housing 5, thereby obtaining the shield connector 1.

In addition, at the time when the outer shell 6 is assembled in the outer housing 5, the assembling operation is carried out in such a manner that the outer edge provided with the earth portion 65 of the outer shell 6 is positioned to be close to the outer edge provided with the second opening 71 of the outer housing 5, and slides toward the other opening 72 of the outer housing 5. Likewise, the inner shell 4 is positioned between the pair of sandwiching portions 66 by means of the sliding operation of the outer shell 6.

In the shield connector 1 assembled as described above, after the substrate-side connection portion 22 is connected to the print substrate, and the earth portion 65 is attached to the housing, the opposite connector is inserted from the other opening 72 of the outer housing 5, thereby carrying out the fitting operation between the opposite terminal and the opposite-side connection portion 21 of the terminal 2, that is, the electric connection operation therebetween. Then, a signal or the like is transmitted between the electric wire and the print substrate via the opposite connector and the shield connector 1.

Further, since the shield connector 1 according to the invention has the higher shield performance as described above, it is possible to restrict an influence of emitted noise. Accordingly, it is possible to prevent a deterioration of a high-speed transmission performance.

Furthermore, the above-described embodiment has a configuration in which the earth portion 65 is directly grounded to the metallic housing of the electronic device, but the invention may have a configuration in which the earth portion is grounded via a metallic shell or the like provided in the opposite connector.

Moreover, the above-described embodiment is an exemplary embodiment of the invention, but the invention is not limited thereto. That is, various modifications can be made in a range without departing from the spirit of the invention.

What is claimed is:

1. A shield connector, comprising:

an L-shaped terminal, including an opposite-side connection portion fitted to an opposite terminal and a substrate-side connection portion extending in a direction perpendicular to the opposite-side connection portion so as to be connected to a print substrate;

an inner housing which holds the terminal;

an inner shell which is formed in a tube shape by bending a metal plate and is attached to an outer periphery of the inner housing in a shape in which the opposite-side connection portion is surrounded;

a tubular outer housing which accommodates the inner shell in a shape in which the opposite-side connection portion is surrounded; and an outer shell which is formed by bending a metal plate and is attached to the outer housing, wherein the inner shell is provided with a notch portion which is formed by cutting a part of the inner shell from an outer edge on the side of a first opening, allowing the inner housing to be inserted therethrough, toward the other opening, allowing the opposite terminal to be inserted therethrough, and which allows the substrate-side connection portion to pass therethrough, wherein the outer housing is provided with a notch portion which is formed by cutting a part of the outer housing from an outer edge on the side of a second opening, allowing the inner shell to be inserted therethrough, toward the other opening, allowing the opposite terminal to be inserted therethrough, and which allows the substrate-side connection portion to pass therethrough, and wherein the outer shell is provided with a covering portion which covers the first opening of at least the inner shell, a pair of sandwiching portions which is bent upward from an outer edge of the covering portion and elastically sandwiches the inner shell therebetween, and an earth portion which is grounded.

2. The shield connector according to claim 1, wherein the first opening of the inner shell and the second opening of the outer housing are disposed on the same plane, and wherein the covering portion covers both the first opening and the second opening.

* * * * *